US005922189A

United States Patent [19]

Santos

[11] Patent Number: 5,922,189

[45] Date of Patent: Jul. 13, 1999

[54] PROCESS TO REFINE PETROLEUM RESIDUES AND SLUDGES INTO ASPHALT AND/OR OTHER PETROLEUM PRODUCTS

[76] Inventor: Benjamin Santos, 38735 Huntington Cir., Fremont, Calif. 94536

[21] Appl. No.: 08/933,638

[22] Filed: Sep. 19, 1997

[51] Int. Cl.[6] ..... C10G 17/00

[52] U.S. Cl. ..... 208/13; 208/33; 208/24; 208/39; 208/43

[58] Field of Search ..... 208/13, 33, 24, 208/39, 43

[56] References Cited

U.S. PATENT DOCUMENTS

| | | | |
|---|---|---|---|
| 3,919,072 | 11/1975 | Pitchford | 208/4 |
| 4,126,538 | 11/1978 | Goudriaan | 208/80 |
| 4,925,588 | 5/1990 | Kappenbeger | 208/48 R |
| 5,288,392 | 2/1994 | Santos | 208/13 |
| 5,514,272 | 5/1996 | Santos | 208/179 |
| 5,573,656 | 11/1996 | Santos | 208/13 |

*Primary Examiner*—Helane Myers
*Attorney, Agent, or Firm*—Ronald C. Fish; Falk & Fish LLP

[57] ABSTRACT

A process for significantly decreasing processing time, reducing capital costs, increasing yield, improving quality, and improving the safety of refining petroleum residues and sludges generated by the oil producers, refineries and re-refiners comprising the steps of heating under vacuum the petroleum residues and sludges with steam or inert gas injection or both until a temperature ranging from between 680° F. to 1000° F. is attained and holding the mixture at this temperature for a short residence time of from less than an hour to abut 6 hours while vacuum and sparging are being carried out to generate asphalt. Volatile products are condensed to produce fuel, waxy oil and can be further processed to produce refined fuel, wax and dewaxed oil.

21 Claims, 3 Drawing Sheets

PROCESS TO REFINE PETROLEUM RESIDUES AND SLUDGES INTO ASPHALT AND/OR OTHER PETROLEUM PRODUCTS

BACKGROUND OF THE INVENTION

1. Field of the Invention

The present invention pertains to refining petroleum residues and sludges, and, in particular, to a process for significantly decreasing processing time, reducing capital cost, increasing yield, improving quality and enhancing refining processes by making them safer.

2. Description of Prior Arts

Huge volumes of petroleum residues and sludges are generated by the oil refineries, petroleum shippers and big users of petroleum and petroleum products. Some examples of petroleum residues are the reduced crude such as short or long residues obtained from crude oil atmospheric or vacuum distillation column, respectively; bottom product of used oil re-refinery using either vacuum applied wipe-film or thin film evaporator. Some examples of petroleum sludges are those obtained from the storage tanks of crude oil, fuel oil number 6 or bunker C, asphalt, slop oil and mixture of any two or more of these sludges.

Prior art processes to produce asphalt and other petroleum products from petroleum crude oil residues include straight reduction of crude oil, propane deasphalting of reduced crude and thermal cracking process.

Straight reduction of crude oil needs two-stage process, an atmospheric distillation column is used first to "top" the crude oil followed by a vacuum distillation unit to process the reduced crude to asphaltic residue and other petroleum products. The two (2) stage process is applicable to crude containing 15–30% asphalt. The asphaltic mixture thus obtained consists mostly of asphaltenes and viscous oil which need further processing using techniques such as propane deasphalting to obtain high quality asphalt of penetration number 60–100 useful as paving asphalt.

Thermal cracking is generally done by heating the oil to 480–610° C. under pressure up to 200 psig. This high pressure and temperature process will crack most of the feed oil and will result in a very low yield of asphalt having low viscosity and high penetration number and is therefore not suitable as paving asphalt for roads and highways.

The overhead products produced thus consist mostly of cracked distillate and light ends which are of lesser commercial value than the oil and wax. In addition, the high pressure, high temperature process entails higher capital cost for equipment.

Propane deasphalting is by far the most widely used method. Atmospheric reduced crude from any primary distillation tower is mixed with liquid propane at a ratio of approximately 1:4 to 1:10 under a pressure of approximately 300 psig. Propane deasphalting has its limitations since it is used primarily for crude oil of relatively low asphalt content, generally less than or equal to 15%. Also, propane deasphalting has a very high capital investment cost, and again considering propane is a highly flammable and explosive gas at room temperature and atmospheric pressure and is used in extremely large quantities, the propane deasphalting process is also considered to be extremely risky.

Other residues such as the bottom products generated by used oil re-refineries using thin-film and wipe-film evaporators and petroleum sludges such as those from the storage tanks of crude oil, bunker C, slop oil, etc. are mostly disposed of through landfill and incineration. Alternatively, in particular, some residue of used oil re-refining plant is disposed of as flux of asphalt product. This means that the residue used is only a small fraction of the end product and therefore, do not significantly decrease the amount of sludge and residue in existence. The traditional disposal method of landfill and incineration has a number of drawbacks. For example, incineration of petroleum sludge or residue produces toxic gaseous emissions to the atmosphere. These emissions include sulphur and sulphur dioxide which are leading causes of acid rain which is causing great damage to Canadian, English, and Scottish forests. In addition, landfill of petroleum sludge or used oil residues is hazardous to health since their components can leach into the water table below.

Thus, there is a need to develop a process to refine and recover the petroleum sludge and residue rapidly, economically and safely.

SUMMARY OF THE INVENTION

The present invention is a process for significantly decreasing the processing time in refining petroleum residue and sludge. The present process comprises the steps of heating under vacuum the petroleum sludges and residue with steam injection until a maximum temperature from between 680° F.–1000° F. is reached, and continuing to hold the materials being processed in this temperature range while steaming materials and holding the material under vacuum for a short residence time so as to produce asphalt and other petroleum products.

In particular, the process of the present invention uses the synergistic effect of combined steam, vacuum, heating and additional residence time at any prescribed maximum temperature to decrease the processing time, increase the quality of asphalt, increase the values of the overhead products, decrease the cost and increase the safety of the process. In addition, the decrease in processing time decreases manufacturing costs thereby enabling the economical production of asphalt and other petroleum products.

DETAILED DESCRIPTION OF THE PREFERRED EMBODIMENT

Figure 1:
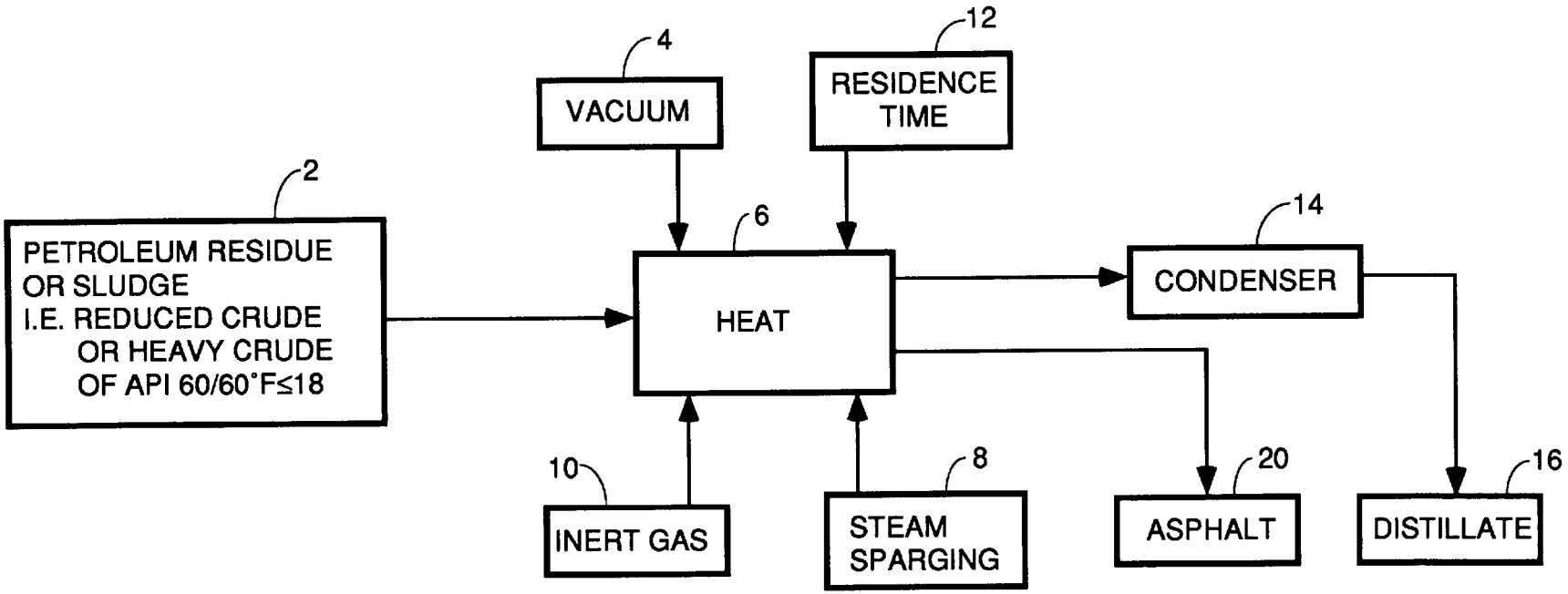
FIG. 1 is a schematic diagram of the refining process of the present invention.

Referring to FIG. 1, the present invention is a process for refining petroleum residues and sludges. The process will decrease the processing time which will enable the rapid and economical refining of petroleum residues and sludges into a high quality asphalt and other petroleum products. The process of the present invention comprises the steps of:

(a) providing petroleum residues of sludge in a container which is airtight but coupled to a vacuum pump (represented by block 2).

(b) applying vacuum to a level sufficient to remove volatile components and light ends that evaporate from the sludge during heating and sparging, usually approximately 29.92" Hg to less than atmospheric temperature (block 4).

(c) heating the residue or sludge while under vacuum to a temperature high enough to evaporate the volatile components of the sludge having boiling points in the range of approximately 680° F. to 1000° F. or lower, i.e., the residues are heated to a temperature in the range from approximately 680° F. to approximately 1000° F. (block 6).

(d) sparging with steam (block 8) or inert gas (block 10) or a combination thereof at a pressure from approximately 20 to approximately 150-psig. Any ratio of the total quantity of steam injected to feed will work but preferably a ratio from approximately 0.10 to approximately 20 is used while heating the residues.

(e) condensing in a condenser the gases that boil off from the heated residue to provide a distillate comprising a superwaxy oil (block 14) and collecting the superwaxy oil in a receiver (block 16) for liquid distillate; and (f) providing residence time (represented by block 12) at maximum temperature during sparging and application of vacuum of from less than approximately 1 hour to approximately 6 hours causes a synergistic effect to remove almost all the wax and oil content of the petroleum sludge or residue to produce a high quality asphalt with a penetration number of from approximately 40 to approximately 300 but preferably approximately 60–100, measured at 25° C., 100 grams and 5 seconds, said asphalt being produced in a short time without the need for dangerous prior art propane based distillation processes described above(block 20).

The process drastically decreases the processing time, decreases the capital cost, increases the yield and quality, and enhances the safety of the operation of processing petroleum residues and sludge.

The process in more detail is as follows: The starting material is petroleum residue or sludge (block 2). Generally, this residue or sludge comprises but is not limited to the following sources: all heavy crude oils having API at 60/60° F. of approximately 18 to 25 or less; atmospheric reduced crude or long residue; vacuum reduced crude or short residue; used oil re-refinery residue derived from vacuum-applied wipe-film or thin-film evaporator; sludges generated from the storage tanks of crude oil, bunker C or fuel oil No. 6; slop oil, mixture of any two (2) or more of these residues and sludges; and any contaminated mixture or type or petroleum residues and sludges with aqueous or nonaqueous elements.

Initially, vacuum (block 4) and heat (block 6) are applied to drive off the volatile components. Some vacuum generating units are steam jet ejectors and mechanical vacuum pumps while example of heat generating units are the gas/fuel oil burners, electrical heating devices and infrared heaters. Vaporization or volatization of light ends can be applied using pipe-still furnace, evaporators, distillation columns or fractionation columns. These process are well known in the art.

The vacuum level can be, for example, from 29.92" Hg to just less than atmospheric pressure, but preferably in the range of 23–29" Hg. Vacuum is applied during heating to help remove volatile components. The vacuum application (block 4) is applied by using a closed container to hold the residue or sludge, the container being coupled to a source of vacuum to evacuate the space above the residue or sludge in the container.

Application of vacuum also functions as a safety mechanism. When the light ends outgas they are in the form of an explosive gas. Therefore, removing the light ends through a vacuum source prevents the accumulation of a gaseous ignitable mixture of various light ends in an area where agitation motors, which generate sparks and heaters, which may use open flames, are operating. The application of vacuum therefore eliminates a potentially explosive situation. These light ends by-products have market value in that they are a potential source of energy. For example, these light ends can be used as fuel for producing power or in heating the next batch of residue or sludge to be refined. Alternatively, the light ends may be used to power all or some energy consuming steps of the refining process according to the teachings of the invention.

In general, the petroleum residues or sludges are heated to a temperature in the range of, from 680° F. to 1000° F., preferably 700°–750° F. During the heating step, steam is sparged or injected into the process. Steam sparging or injection (block 8) also facilitates the removal of volatile components. The phrase "Steam Sparging" means bubbling steam through the solution. In the present process, steam can be injected at any pressure but preferably in the range of from 20 to 150-psig. Also, any ratio of the total quantity of steam injected to feed will work but preferably from 0.10 to 20. Supersaturated steam is preferable to saturated steam because of its better steam quality which means less water vapor or oxygen that can chemically interact with the residue. Saturated steam is usually injected when the process temperature is slightly higher than the saturation temperature of the steam in order to minimize condensation and cooling of steam which means longer heating time and more fuel for the process.

Again, in the present process, the simultaneous or combined application of steam injection and vacuum during heating plus a residence time of from less than 1 hour to approximately 6 hours produces a synergistic effect that can rapidly and significantly remove almost all the wax and oil content of the petroleum sludge or residue to produce a high quality asphalt with a penetration number of from 40–300 but typically 60–100, measured at 25° C., 100 grams and 5 seconds, conforming to ASTM #D5-86 as the bottom products.

The overhead product which is boiled off and recondensed is a superwaxy oil. It is condensed at condenser (block 14) and collected in the receiver (block 16). A typical condenser is the shell and tube heat exchanger using water as the cooling medium. Any cooling techniques such as air or refrigeration will work but a closed system is preferred because of the inherent odor present in the condensate.

The condensate or the superwaxy oil can be used as fuel or as regular oil. This oil can be refined further using conventional refining techniques such as hydrotreating, acid-clay treatment, or percolation method which are all well known in the art, to produce higher quality products.

Steam sparging also functions as an additional safety mechanism in addition to vacuum application since steam is an inert gas which can dilute and lean the explosive gas so that they are less likely to ignite and explode.

The prior art teaches using heat and vacuum application as in straight reduction; using heat and pressure as in thermal cracking and using solvent and pressure as in propane deasphalting. These processes resulted in either poor quality, low yield, long processing time or high capital cost, high manufacturing cost and were risky operations.

In alternative embodiments where steam sparging is not used, inert gas (block 10) may be pumped into the closed chamber holding the residue during heating (block 6). The function of the inert gas is similar to that of steam, i.e. prevent the possibility of explosion but it functions in a slightly different way in that it prevents a combustible mixture from forming in the overhead spaces by displacing or reducing the amount of oxygen in the overhead space.

Any inert gas may be used. Typically, nitrogen and carbon dioxide work well. Nitrogen is preferred since carbon dioxide has greenhouse gas effect and is detrimental to the environment.

In still another alternative embodiment, a combination of steam and inert gas may be used to reduce the risk of explosion.

In either alternative embodiment, the distillate collected in block 16 can further be processed using conventional method such as percolation, acid-clay and hydro-treating to produce high quality fuel or oil.

Figure 2:
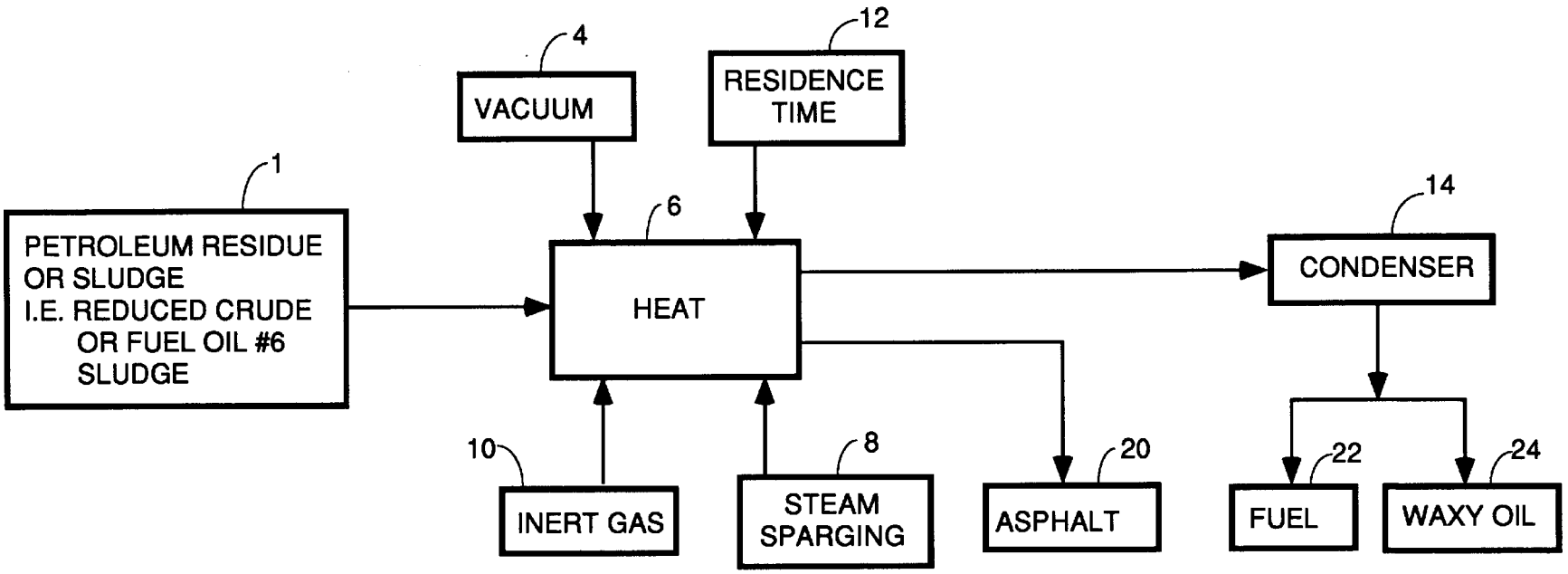
FIG. 2 is a schematic diagram of the refining process of the present invention in which the overhead distillate product is fractionated into fuel and waxy oil respectively.

FIG. 2 is a process flow diagram showing an alternate embodiment of the present process for refining petroleum residue or sludge. The process comprises the steps of: applying vacuum (block 4), heating the residue or sludge (block 6); sparging with steam (block 8) or inert gas (block 10) or combination thereof, while heating the residue or sludge; condensing the light ends that are boiled off to produce two distillates in two (2) receivers (blocks 22 & 24); one for fuel and one for waxy oil; and providing sufficient residence time at the prescribed maximum temperature (blocks 12) to produce pavement asphalt with penetration number in the range of 40–300 but typically 60–100 measured at 25° C., 100 grams and 5 seconds (block 20).

In this preferred embodiment, the overhead product which is the distillate is collected in two (2) fractions; one for the fuel which is collected between room temperature and about 600° F., and the other one for the waxy oil which is collected between and above 600° F., and 1000° F. preferably between above 600° F. and about 750° F. including all the distillate collected during residence time. Preferably this is done by heating the residues and sludge to a first temperature sufficiently high to boil off the light ends that condense as fuel and holding the mixture at this temperature long enough to boil off all these light ends. During this time, the output of the condenser is directed in the receiver 22 for fuel. Then the temperature is raised to a temperature to boil off the waxy oils and held at this temperature long enough to distill substantially all the waxy oils out of the residue and sludge. During this time, the output of the condenser is collected In the receiver 24 for waxy oil. (Ben: I am not too sure about this part of the process on how to separate the waxy oil from the fuel since the temperature ranges overlap). The fuel and waxy oil can be further processed using conventional methods such as percolation; acid clay or hydrotreating to produce high quality fuel and waxy oil.

Figure 3:
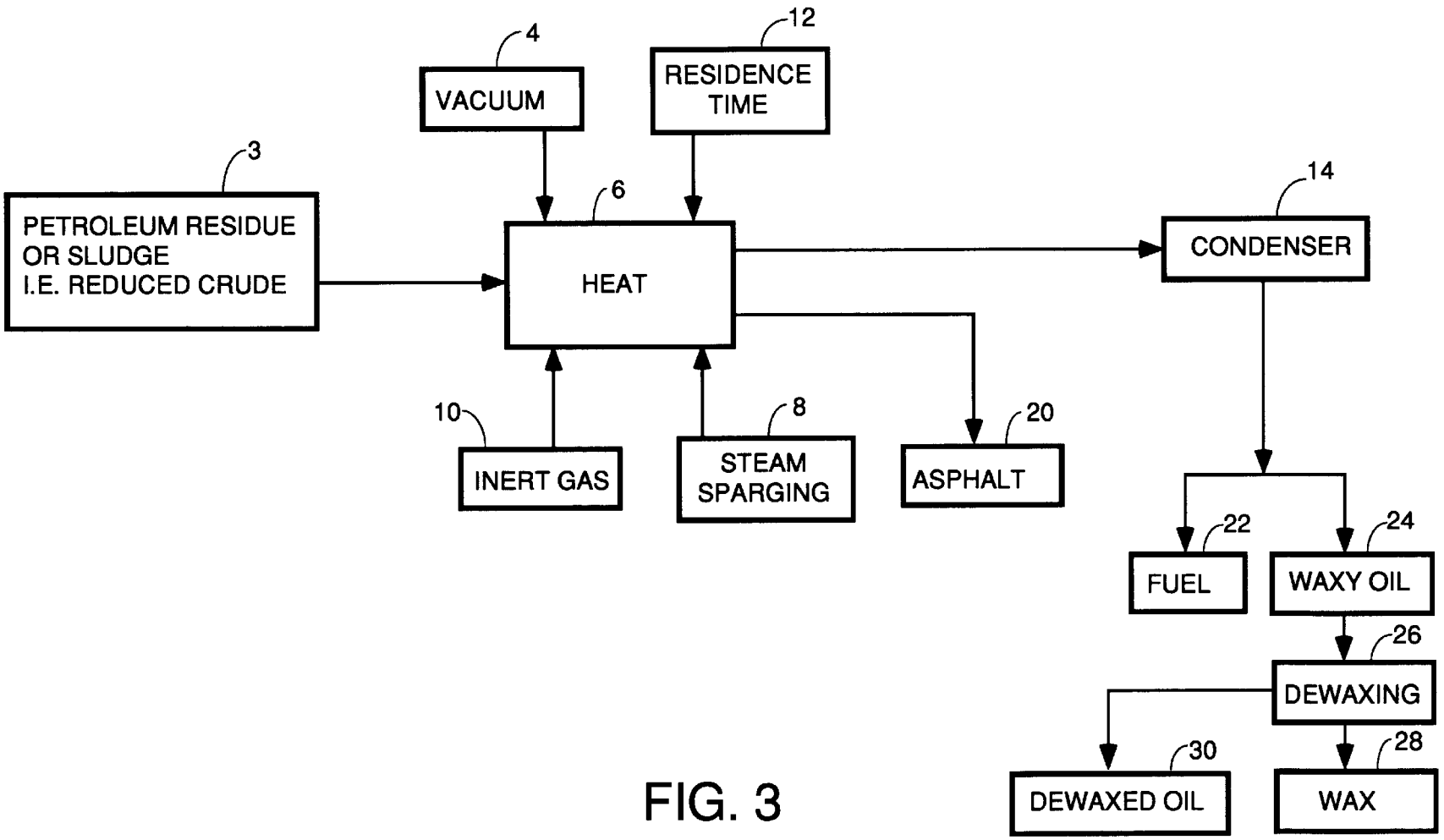
FIG. 3 is a schematic diagram of the refining process of the present invention in which the waxy oil of the distillate products is further dewaxed into wax and dewaxed oil.

FIG. 3 is a process flow diagram showing another embodiment of the present process for refining petroleum residue or sludge. The process comprises the steps similar to FIG. 2 except that the fraction of distillate collected as waxy oil is further processed and dewaxed (block 26) to produce a wax product (block 28) and a dewaxed oil (block 30). The process of dewaxing can be pressing and sweating, centrifuging and the method of solvent dewaxing. These are all well known in the art. The present process can use any of these dewaxing methods but preferably the solvent dewaxing method. This dewaxing method uses solvents such as methyl ethyl ketone and toluene, which is blended with waxy oil. The solvent-to-oil ratio is generally from 1:1 to 4:1. The blend is then chilled to a temperature of approximately 10° F. to 30° F. using chiller such as ammonia chiller. A rotary vacuum filter is then used to separate the dewaxed oil from the wax. The average wax content of the waxy oil is about 6 to 12 percent. The fuel, wax and dewaxed oil can be further processed using conventional methods such as hydrotreating; percolation through activated bauxite, activated carbon, bleaching clay and Fuller's Earth; and acid-clay treatment to generate high quality refined fuel, wax and dewaxed oil. The refined dewaxed oil may be blended with additives or virgin base oil to enhance its quality and attain the viscosity that is highly marketable.

Virgin asphalt stock may also be blended with the asphalt derived from petroleum sludge to further enhance its quality. Other additives which may be blended with the asphalt product of the present invention includes polymers or resins to enhance adhesion and cohesion qualities, rubber or rubber compounds to produce rubberized asphalt, solvents to produce cutback asphalt, and water and emulsifying agents to produce emulsified asphalts.

The invention is further illustrated by the following specific but non-limiting examples. Examples which have been reduced to practice are stated in the past tense, and examples which are constructively reduced to practice herein are presented in the present tense. Temperatures are given in degrees Fahrenheit unless otherwise specified.

EXAMPLE

Sample of reduced crude was obtained for use in the present invention. The initial chemical properties of the residue or reduced crude was measured and are listed below in Table 1. Three aliquots were removed from the reduced crude. Each aliquot or sample was then subjected to the present process. The first sample was sparged with steam, weight of steam per weight of residue crude was 0.30, and no vacuum was applied. The second aliquot was subjected to vacuum at a level of approximately 25" Hg, but no steam was injected. The third sample was subjected to both steam injection and vacuum, the ratio of the weight-of-steam divided by the weight-of-reduced-crude being approximately 0.3 and the vacuum level was approximately 25" Hg. All the samples were heated to 725° F. The residence time of each was varied to indicate end point. The results are listed in Table II. As indicated in Table II, Sample 1 which used only steam and Sample 2 which used only vacuum both resulted in generating an asphalt product that is too soft as pavement asphalt. In addition, the length of residence time at maximum temperature of 725° F. for both samples reaches more than 5 hours. Sample 3 which use the combined steam and vacuum took less than 2 hours of residence time at 725° F. to produce an asphalt having a penetration number of 60–100 measured at 25° C., 100 grams and 5 seconds and conforming to ASTM D-946 specification for road asphalt cement. In addition, it yielded more waxy oil which has higher commercial values than Samples 1 and 2.

TABLE I

| Characteristics | Residue (Reduced Crude) |
|---|---|
| Color | Black |
| A.P.I Gravity at 60/60° F. ASTM D287 | 14–15 |
| Viscosity, cst @ 50° C., ASTM D445 | 230 |
| Pour Point, ° C. ASTM D97 | 4 |
| Water, ASTM D95 | nil |
| Flash Point, ° C., ASTM D93 | 82 |

TABLE II

| Sample Number | wt. steam ÷ wt. residue | Vac. in.-Hg | Max Temp. ° F. | Residence Time in Hrs. | YIELD Fuel % | Waxy Oil % | Asphalt % | *Pen. No.** |
|---|---|---|---|---|---|---|---|---|
| 1 | 0.3 | n/a | 725 | 5–6 | <10 | <30 | >60 | >250 |
| 2 | n/a | 25 | 725 | 5–6 | <10 | <30 | >60 | >250 |
| 3 | 0.3 | 25 | 725 | 1–2 | 10–15 | 40–50 | less than or equal to 40 | 60–100 |

*Conforming to ASTM D946
**Penetration Number measured at 25° C., 100 grams and 5 seconds ASTM D5-86

What is claimed is:

1. A process for refining petroleum residue or sludge comprising the steps of:

providing petroleum residue or sludge, applying vacuum in the range of from approximately 29.92" Hg to less than atmospheric pressure, heating the residue or sludge to a temperature in the range of from approximately 680° F. to approximately 1000° F., sparging with steam or inert gas or a combination thereof while heating the oil, condensing volatile products which boil off from said residue or sludge;

collecting distillates from said condensing step; and maintaining said residue or sludge at a temperature in said range of temperatures while subjecting said residue or sludge to steam sparging and application of vacuum for a time adequate to produce asphalt having adequate penetration number.

2. The process of claim 1 wherein the ratio of the weight of steam injected to the weight of the residue is approximately 0.10 to approximately 20.

3. The process of claim 1 wherein the combined application of steam, heat and vacuum at a maximum temperature in the range of from approximately 680° F. to approximately 850° F., for a residence time of less than 3 hours to produce an asphalt having penetration number of approximately 40–300 measured at 25° C., 100 g and 5 seconds per the ASTM D5-86 test protocol.

4. The process of claim 1 wherein the step of sparging comprises the step of bubbling steam through the petroleum residue or sludge mixture derived from saturated or supersaturated steam.

5. The process of claim 1 wherein the step of providing petroleum residue comprises the step of providing reduced crude or mixture of long and short residues.

6. The process of claim 1 wherein the step of providing petroleum residue or sludge comprises the step of providing petroleum residue of heavy crude having an API at 60/60° F. of approximately 25 or less.

7. The process of claim 1 wherein the condensing step comprises condensing fuel from the light ends and wherein the step of maintaining the residue or sludge at a temperature produces asphalt and wherein the step of providing petroleum residue or sludge comprises the step of providing petroleum residues from crude oil atmospheric or vacuum distillation column or bottom products from used oil re-refineries using either the vacuum applied wipe-film or thin film evaporator or any other contaminated mixture or type of petroleum residues and sludges with aqueous or nonaqueous elements.

8. The process of claim 1 wherein the step of condensing produces waxy oil and fuel.

9. The process of claim 8 further comprising the step of dewaxing the waxy oil to produce wax and dewaxed oil.

10. The process of claim 1 wherein the sparging step comprises either bubbling inert gas through the mixture of sludge or petroleum residues or filling the space in an airtight container above the petroleum residues or sludge with a sufficient amount of inert gas to reduce the risk of explosion as volatile components outgas from the heated sludge or petroleum residue.

11. The process of claim 1 wherein the step of providing petroleum residue or sludge comprises the step of providing sludges from storage tanks of crude oil, fuel oil number 6, slop oil or sludge from a combination of any 2 or more of the above.

12. The process of claim 1 wherein the heating temperature is in the range from approximately 680° F. to approximately 750° F.

13. The process of claim 1 wherein the vacuum applied is in the range of from approximately 23" to approximately 29" Hg and the sparging step comprises bubbling steam through the residue or sludge or pumping inert gas into the space above the residue or sludge or both.

14. The process of claim 1 wherein the step of condensing causes distillates to be collected, and further comprising the step of refining the the distillates using hydrotreating, acid-clay treatment or percolation methods to generate at least refined fuel.

15. The process of claim 1 wherein the step of condensing causes fuel and waxy oil to be collected, and further comprising the step of refining the the fuel using hydrotreating, acid-clay treatment or percolation methods to generate at least refined fuel, and further comprising the step of dewaxing the waxy oil to generate wax and dewaxed oil.

16. The process of claim 1 further comprising the step of adding an additive to the asphalt, the additive being selected from the group consisting of virgin asphalt stocks, polymers or resins, rubber or rubber compounds, solvents and water and emulsifying agents.

17. A process for refining petroleum residue or sludge comprising the steps of:

providing feed oil comprising heavy crude oils having API at 60/60 degrees F of approximately 18 to 25, atmospheric reduced crude or long residue, vacuum reduced crude or short residue, used oil re-refinery residue derived from vacuum-applied wipe-film or thin-film evaporators, sludges from storage tanks of crude oil, bunker C or fuel oil number 6, slop oil or a mixture or any of the above, applying vacuum adequate to suck any vapors from volatile products off to a condenser, while said vacuum is being applied, heating the feed oil in an airtight compartment to a temperature above approximately 680° F. for a residence time of from less than one hour up to about six hours to boil off any volatile products having boiling points below approximately 680° F. and simultaneously sparging with steam or inert gas or a combination thereof to help remove volatile products, wax and oil content and reduce the risk of explosion and maintaining the mixture at a temperature above approximately 680° F. while vacuum and sparging are being applied for a residence time sufficient to yield asphalt having an adequate penetration number, and condensing volatile products which boil off from said residue or sludge to generate fuel and waxy oil in separate collectors.

18. The process of claim 17 further comprising the step dewaxing the waxy oil to produce wax and dewaxed oil, and using the residue left after volatile compounds, wax and oil have been removed from said feed oil as high quality asphalt having a penetration number from 40–300 measured at 25 degrees C, 100 grams and 5 seconds conforming to ASTM #D5-86.

19. The process of claim 17 further comprising the step of refining the fuel using hydrotreating, acid-clay treatment or percolation methods to generate at least refined fuel.

20. A process for refining petroleum residue or sludge comprising the steps of:

providing feed oil comprising heavy crude oils having API at 60/60 degrees F of approximately 18 to 25, atmospheric reduced crude or long residue, vacuum reduced crude or short residue, used oil re-refinery residue derived from vacuum-applied wipe-film or thin-film evaporators, sludges from storage tanks of crude oil, bunker C or fuel oil number 6, slop oil or a mixture or any of the above, applying vacuum adequate to suck any vapors from volatile products off to a condenser using a vacuum steam jet ejector or vacuum pump, while said vacuum is being applied, heating the feed oil in an airtight compartment of a gas/fuel oil burner, electrically heated container or container exposed to infrared heaters with a space above the liquid level of said feed oil coupled to said vacuum source such that said feed oil is heated under vacuum conditions to a temperature above approximately 680° F. to boil off any volatile products having boiling points below the temperature to which the feed oil is heated and simultaneously sparging with steam or inert gasor a combination thereof at a pressure of from 20 to 150 psig to help remove volatile products, wax and oil content and reduce the risk of explosion and maintaining the mixture at a temperature above approximately 680° F. while vacuum and sparging are being applied for a residence time sufficient to yield asphalt having a penetration number from 40–300 and conforming to ASTM #D5-86, and condensing volatile products which boil off from said residue or sludge in any type of facility suitable to do this such as a pipe-still furnace, evaportor, distillation column or fractionation column to generate fuel and waxy oil in separate collectors.

21. The process of claim 20 further comprising the steps of:

dewaxing the waxy oil to produce wax and dewaxed oil;

refining the fuel using hydrotreating, acid-clay treatment or percolation methods to generate at least refined fuel; and adding an additive to the asphalt to improve the characteristics thereof, the additive being selected from the group consisting of virgin asphalt stocks, polymers or resins, rubber or rubber compounds, solvents and water and emulsifying agents.

* * * * *